US009781774B1

(12) United States Patent
Boivin et al.

(10) Patent No.: US 9,781,774 B1
(45) Date of Patent: Oct. 3, 2017

(54) HEATING ELEMENT AND FUSION FURNACE COMPRISING SAME

(71) Applicant: SPEX Sample Prep LLC, Metuchen, NJ (US)

(72) Inventors: Marc Boivin, Wendake (CA); Pierre-Emmanuel LeMay, Quebec (CA); Alain Chantal, St-nicolas (CA); Antoine Fiala, St-Romuald (CA); Marco Bernier, Rivière-du-Loup (CA)

(73) Assignee: SPEX Sample Prep, LLC, Metuchen, NJ (US)

( * ) Notice: Subject to any disclaimer, the term of this patent is extended or adjusted under 35 U.S.C. 154(b) by 469 days.

(21) Appl. No.: 14/452,250

(22) Filed: Aug. 5, 2014

(51) Int. Cl.
*H05B 3/10* (2006.01)
*H05B 3/62* (2006.01)

(52) U.S. Cl.
CPC ..... *H05B 3/62* (2013.01)

(58) Field of Classification Search
CPC ..... F27B 17/02; F27B 17/0016; F27B 14/14; F27B 14/00; F27B 14/06; F27B 14/061; F27B 2014/0862; F27B 2017/0091; F27D 19/00; F27D 3/14; F27D 99/0001; F27D 99/0006; F27D 11/00; F27D 11/02; F27D 2005/0081; F27D 21/0018; G01N 23/2202; G01N 1/44; H05B 3/62; H05B 3/64; H05B 3/66
See application file for complete search history.

(56) References Cited

U.S. PATENT DOCUMENTS

| | | | |
|---|---|---|---|
| 4,329,136 A | 5/1982 | Willay et al. | |
| 5,315,091 A | 5/1994 | O'Brien et al. | |
| 2003/0110893 A1* | 6/2003 | Eckert | C22B 9/00 75/678 |

FOREIGN PATENT DOCUMENTS

| | | |
|---|---|---|
| CN | 101318822 A | 12/2008 |
| CN | 101854749 B | 11/2012 |

* cited by examiner

*Primary Examiner* — Shawntina Fuqua
(74) *Attorney, Agent, or Firm* — Kaplan Breyer Schwarz, LLP

(57) ABSTRACT

A heating element includes a filament that conducts electricity. In some embodiments, the filament is encapsulated in a silicon nitride cover. The heating element provides a heating zone located relatively closer to the tip of the heating element and relatively further from a connection where electrical leads connect to the filament.

20 Claims, 11 Drawing Sheets

HEATING ELEMENT AND FUSION FURNACE COMPRISING SAME

FIELD OF THE INVENTION

The present invention relates generally to the preparation of inorganic samples via fusion.

BACKGROUND OF THE INVENTION

Analyzing an inorganic sample via analytical techniques such as x-ray fluorescence (XRF), inductively coupled plasma (ICP), atomic absorption (AA) requires that the sample be specially prepared before analysis. In particular, the sample must often be in the form of a solid, smooth-surface shape, such as that of a disk or bead. In this form, the sample does not exhibit mineralogical, grain-size, or orientation effects that might otherwise skew the analytical results.

A process known as "fusion" can be used to prepare samples for XRF, ICP, and AA. During this process, a powdered sample is dissolved into a solvent, typically a lithium borate flux. The flux is solid at room temperature and therefore must be liquefied. As a consequence, the fusion process is conducted in a furnace/oven, sometimes called a "fluxer".

To prepare a sample, a precise amount of sample and flux, along with a small amount of a non-wetting agent, are added to a platinum crucible and placed in a fluxer. Upon heating, the flux melts and dissolves the sample. The sample itself never actually melts; it is merely dissolved into the liquefied flux. After complete dissolution, the hot solution is poured into a mold that was also placed in the fluxer. The non-wetting agent prevents the melted flux from sticking to the crucible. Upon cooling, a small, homogeneous glass-like disk or bead of sample results.

Since, as previously indicated, the sample does not melt, the fusion temperature depends almost exclusively on the flux used. Lithium tetraborate (LiT), for example, melts at 920° C. and has the highest melting point of common fluxes. The choice of a particular flux or flux blend depends on sample type. In fact, process temperatures can reach 1200° C. in the fluxer, which poses substantial challenges to the durability of the materials and parts used in the process. At these high temperatures, most materials will burn, melt, rapidly oxidize in the presence of the oxygen, or even be attacked by the halogen gases that are released upon heating.

Fluxers can be driven by gas or electricity. A gas flame provides a quick source of heat, but achieving a precise furnace temperature can be difficult to monitor and adjust. Also, safety concerns over flammable gases in laboratories have prompted many users to switch to electrically powered furnaces, either inductive or resistive.

Although safer than gas, induction furnaces are difficult to calibrate. There have been many reported incidents of overheating, which can lead to damages to the platinumware (e.g., the crucible, etc.) and analytical errors due to evaporation of flux.

The closed compartments of resistive furnaces offer the best temperature stability and accuracy. However, a drawback to resistive furnaces concerns the heating elements. Only a few materials have been used as heating elements for a fusion furnace due to the extreme temperatures required: silicon carbide (SiC), molybdenum disilicide ($MoSi_2$), and iron-chromium-aluminum alloy (FeCrAl).

The electrical characteristics of SiC change over time due to heat exposure. Thus, it is not feasible to replace a single heating element filament in a multi-element configuration. But not replacing a filament when required reduces the life expectancy of the remaining filaments, since they must be driven harder. $MoSi_2$ becomes very brittle upon cooling. This material is also known to react with halogens and degrade prematurely as a consequence thereof. At high temperatures, FeCrAl softens and coil-shaped elements will deform to the point that the turns of a helically wound resistive heating coil (in many prior art designs) will approach one another, leading to element failure due to localized overheating. Additionally, FeCrAl is vulnerable to chemical attack by the flux or halogen compounds. Also, some of these materials can slowly oxidize, reducing the size of the filament and hence its ability to handle power. As a result, the filaments can burn out.

As a consequence, a need remains for improvements in fusion furnace design.

SUMMARY OF THE INVENTION

Embodiments of the invention provide a fusion oven and fusion process that avoids some of the drawbacks of the prior art.

In accordance with the illustrative embodiment of the invention, an improved fusion oven includes a novel heating element. In the illustrative embodiment, the heating element includes an electrically conductive (or semi-electrically conductive) material having a melting point of 1200° C. or more encased in protective cover made of silicon nitride. In some other embodiments, the cover can be made of other non-oxide containing ceramics.

Conventional heating elements provide relatively constant heat over their full length. A heating element in accordance with the illustrative embodiment provides a heating zone, located relatively closer to the tip of the element and relatively further from the connector where electrical leads connect to the heating element. This prevents the electrical leads, etc., at the connector from overheating.

Additional embodiments of the invention are disclosed in the Detailed Description section of this Specification.

DETAILED DESCRIPTION

Figure 1:
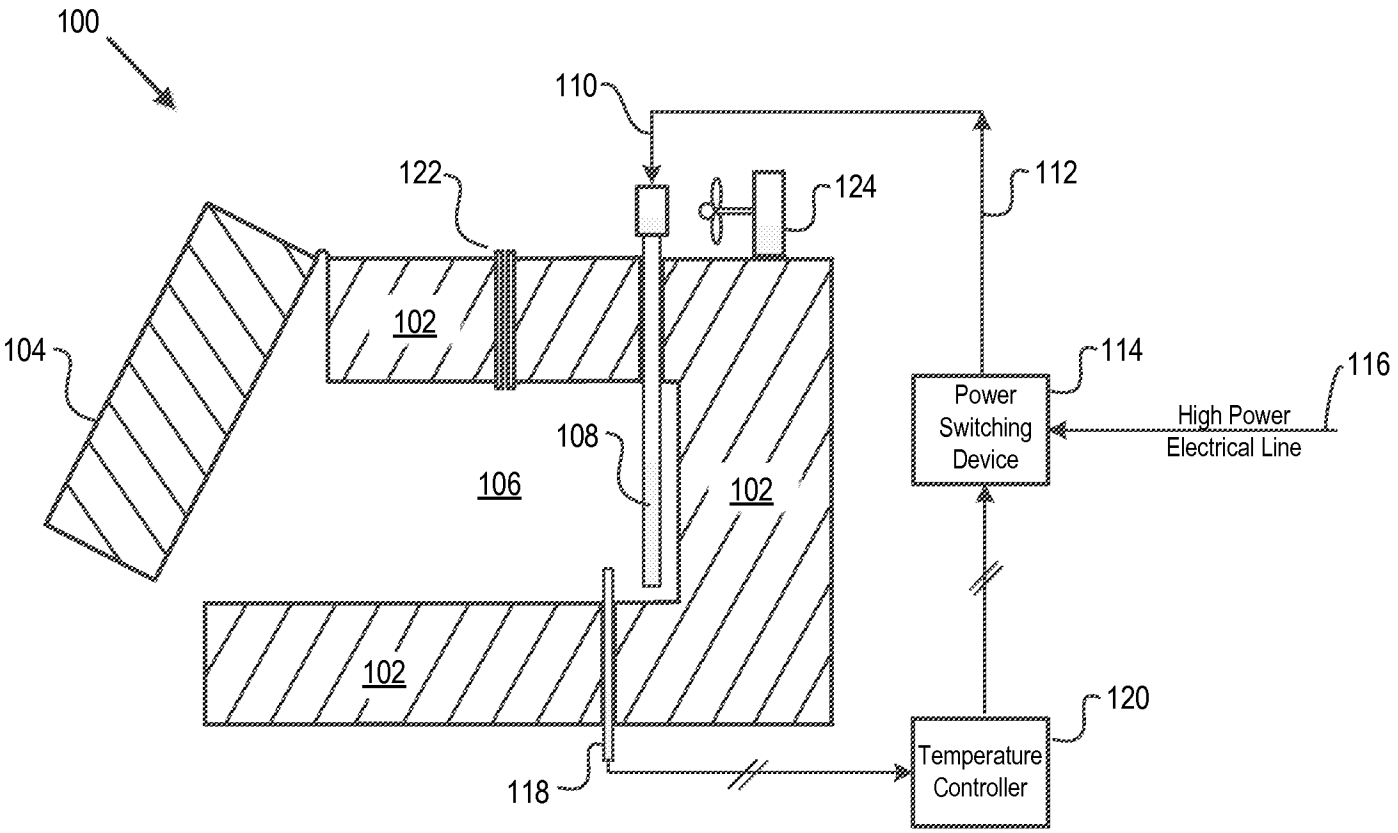
FIG. 1 depicts furnace or fluxer for implementing the illustrative and alternative embodiments of the invention.

FIG. 1 depicts the salient elements of furnace or fluxer 100, including a heating element in accordance with the present teachings. As previously noted, a fluxer is used to prepare samples for analysis in XRF, ICP, and AA. Fluxer 100 comprises inner cavity walls 102, door 104, inner cavity 106, heating elements 108 (only one of which is shown in FIG. 1), electrical leads 110 and 112, power switching device 114, high power electrical lead 116, temperature sensing device 118, temperature controller 120, vent 122, and cooling element 124, interrelated as shown.

A platinumware assembly (not depicted) is used in conjunction with fluxer 100. The platinumware assembly is arranged to slide in and out of the fluxer's inner cavity 106. The platinumware assembly includes a crucible holder, which supports a plurality of platinum crucibles, and a mold rack, which supports a like number of platinum molds.

To prepare samples for XRF, etc., powered sample, flux, and a non-wetting agent are added to one or more of the crucibles. The sample-bearing crucibles are then placed in the crucible holder. The crucible holder is supported above the mold rack and is capable of partially rotating to pour the contents of the crucibles, once molten, into the underlying molds. Once the flux and sample are deposited into the crucibles, the assembly is moved into cavity 106 and door 104 closes to begin the fusion process. See, e.g., http://www.katanax.com/cgi/show.cgi?products/K2prime/K2primevideo.I=en.html. The door and walls 102 of system 100 are thermally insulated in order to maintain an accurate fusion temperature within cavity 106.

The operator of system 100 is typically aware of the type of flux or flux blend that is added to the sample, and because the fusion temperature depends almost exclusively on the flux or flux blend used, a closed-loop feedback system is employed to monitor and control the temperature within cavity 106 for melting the flux or flux blend.

The closed-loop feedback system comprises, for example, and without limitation, sensing device 118, controller 120, power switching device 114, and heating elements 108. As shown in FIG. 1, one end of sensing device 118 extends into cavity 106 while the other end of sensing device 118 is located outside of cavity 106 and electrically connected to an input of controller 120. Sensing device 118 is configured to measure the temperature in cavity 106 and output a signal to controller 120 indicating the same. Upon receiving this signal from sensing device 118, controller 120 determines whether cavity 106 has reached the desired temperature for melting the flux or flux blend.

When controller 120 determines that cavity 106 has reached the desired temperature, controller 120 may output a signal to power switching device 114, wherein the signal causes device 114 to maintain the desired temperature within cavity 106. This enables the flux or flux blend to be heated at the desired temperature for a certain period of time in order to allow the flux or flux blend to melt. On the other hand, when controller 120 determines that cavity 106 has not reached the desired temperature, controller 120 may output a signal to power switching device 114 to increase the temperature within cavity 106. In both cases, power switching device 114 is configured to draw power from a power supply via high power electrical lead 116. The electricity received by power switching device 114 is converted to an appropriate voltage and propagated to electrical leads 110 and 112 to heat the filament of each heating element 108. The flux or flux blend is melted and the gas produced during the fusion process is exhausted through vent 122.

Although a closed-loop feedback system has been described as the means for monitoring and controlling the fusion temperature within cavity 106, it will be clear to those skilled in the art, after reading this disclosure, how to make and use alternative embodiments of the invention in which other feedback systems can be used to monitor and control the temperature within cavity 106.

In addition to the components described above, fluxer 100 also comprises cooling element 124, which is used to prevent the connector of heating element 108 from overheating. In the illustrative embodiment, cooling element 124 is a fan. Cooling element 124 is optional since the heating element according to the illustrative embodiment provides a mechanism to prevent the connectors from overheating without using cooling element 124. Nevertheless, cooling element 124 can be incorporated into fluxer 100 to extend the longevity of the heating elements of the invention. The heating element in accordance with the illustrative and alternative embodiments of the invention will now be described in more detail.

Figure 2:
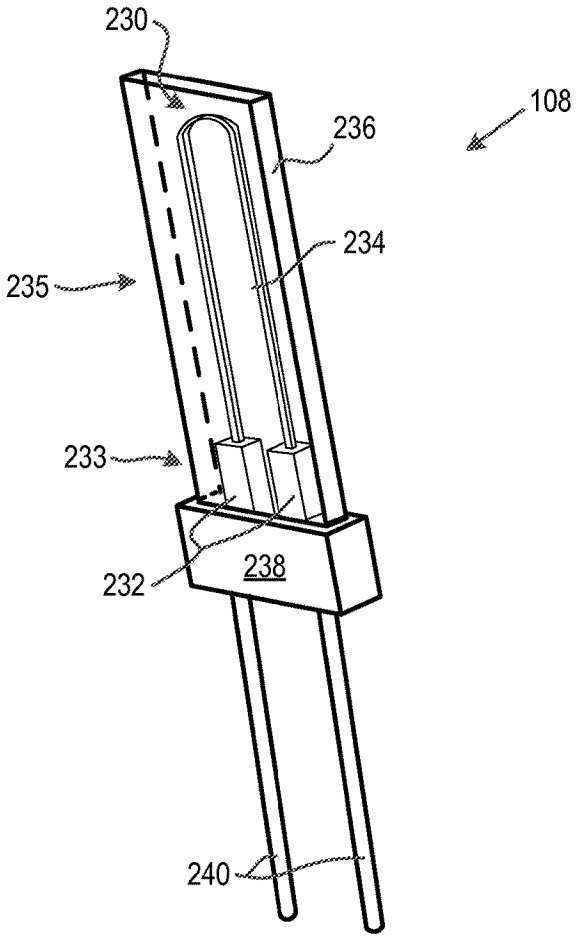
FIG. 2 depicts a heating element in accordance with the illustrative embodiment of the invention.

FIG. 2 depicts heating element 108 in accordance with the illustrative embodiment of the invention. Heating element 108 comprises filament 230, protective cover 236, connector 238, and electrical leads 240, arranged as shown.

Filament 230 comprises an electrically conductive or semi-conductive material. Any electrically conductive or semi-conductive material having an acceptably high melting point (i.e., about 1200° C. or more) is suitable for use as filament 230. Examples of such material include, without limitation, tungsten, molybdenum, tantalum, niobium, rhenium, osmium, carbon, or any combination thereof.

Filament 230 comprises relatively lower electrical-resistance portion 232 and relatively higher electrical-resistance portion 234. Filament portion 232 generates first heating zone 233 and filament portion 234 generates second heating zone 235. Portion 232 will generate less heat than portion 234 for a given amount of applied electrical current since portion 232 has the lower electrical resistance. The temperature of first heating zone 233 will therefore be lower than the temperature of second heating zone 235. In the illustrative embodiment, the relatively lower electrical resistance of filament portion 232 results from the fact that it comprises substantially more material than filament portion 234. In other embodiments, other techniques known to those skilled in the art for varying the electrical resistance of the portions 232 and 234 may suitably be used.

By virtue of the configuration of filament 230, connector 238 and electrical leads 240 are subjected to the relatively lower temperatures of first heating zone 233, being somewhat distant from the relatively higher temperatures of second heating zone 235. This reduces the incidence of overheating of connector 238 and leads 240, and, therefore, reduces a tendency for premature degradation of those elements. In an ideal case, the first heating zone generates zero or near zero heat. However, in such a simple structure of filament 230, this goal is rather difficult to achieve.

Although FIG. 2 depicts filament portions 232 and 234 of filament 230 as having a particular shape, size, etc., it will be clear to those skilled in the art, after reading this disclosure, how to make and use alternative embodiments of the invention in which the filament portions have shapes and relative sizes different than those depicted in FIG. 2.

In addition to preventing the electrical leads 240 and connector 238 from overheating, heating element 108 is also physically adapted to prevent filament 230 from chemical attack and oxidation during the fusion process. In particular, in the illustrative embodiment, heating element 108 includes cover 236, which comprises silicon nitride ($Si_3N_4$) and completely surrounds filament 230. Silicon nitride is a ceramic-like material that can withstand high temperatures. Contrary to most other ceramics, silicon nitride does not contain oxygen, and, as such, will reduce the tendency for filament 202 to oxidize. In some further embodiments, cover 236 comprises other non-oxide containing, ceramic or ceramic-like materials.

Cover 236 has the additional advantage of protecting filament 230 from chemical attack since the silicon nitride is substantially impervious to the chemicals that might have accidently come into contact with the heating elements during the fusion process. Cover 236 can be made in accordance with the method described in CN101854749 and CN101318822, which are incorporated herein by reference.

FIGS. 3 through 11 depict heating element 108 in the inner cavity of a variety of furnaces/fluxers, wherein the fluxers differ in terms of the configuration of the inner cavity. Since all such fluxers otherwise share the same basic elements, such as most of those depicted in FIG. 1 (e.g., power switching devices, temperature sensing devices, temperature controllers, vents, cooling elements, etc.), only the elements that differ are depicted; that is, the configuration of the inner cavity and the arrangement of the heating elements. Although each heating element 108 has a length, width, height, shape, and orientation appropriate for the cavity in which it is used, it will be clear to those skilled in the art, after reading this disclosure, how to make and use alternative embodiments of the invention in which heating elements 108 can have a different length, width, height, shape, and/or orientation that is otherwise appropriate for the configuration of the inner cavity of the furnace.

Figure 3:
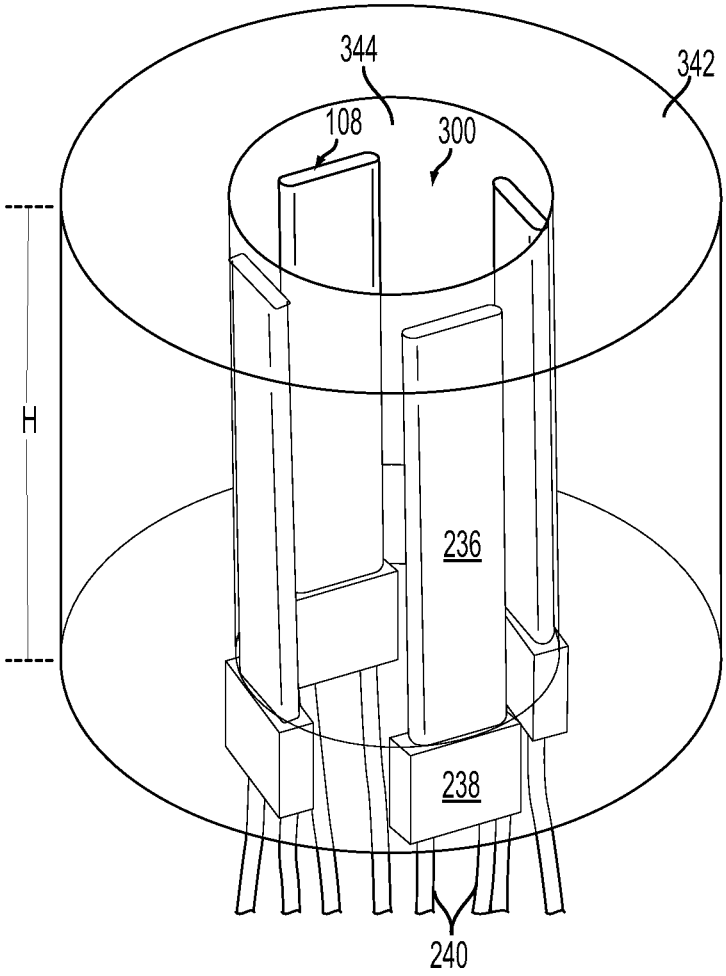
FIG. 3 depicts a plurality of the heating element of FIG. 2 arranged along the inner surface of a wall that defines a cylindrical inner cavity of a fluxer.

FIG. 3 depicts a plurality of heating elements 108 disposed within cylindrical inner cavity 300 of a furnace according to an embodiment of the invention. Inner cavity 300 is defined by wall 342 of ceramic material. Wall 342 is analogous to wall 102 that defines heated cavity 106 of FIG. 1. Heating elements 108 are disposed all along inner surface 344 of wall 342.

Cover 236 of each heating element 108 has a length that is substantially the same as height H of wall 342, wherein connector 238 and electrical leads 240 are disposed outside of (i.e., below in FIG. 3) inner cavity 300.

Figure 4:
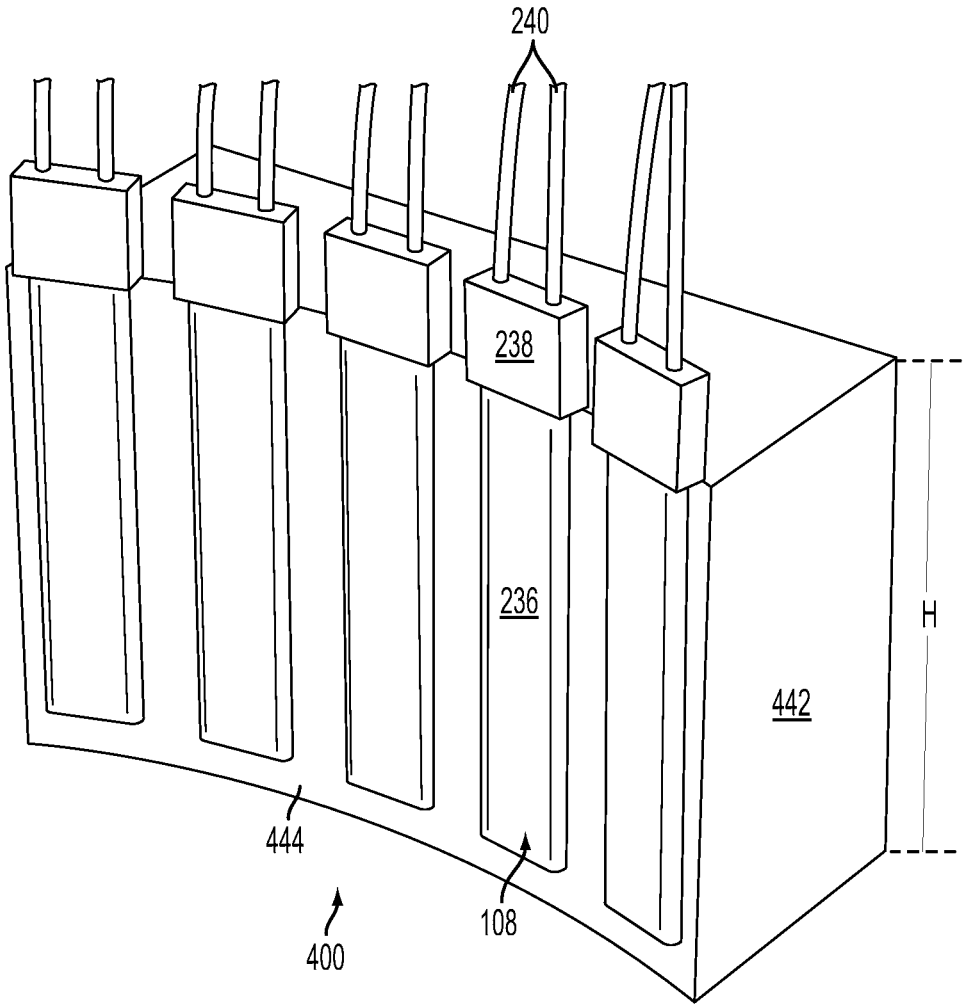
FIG. 4 depicts a plurality of the heating element of FIG. 2 arranged along a concave inner surface of a wall that defines an inner cavity of a fluxer.

FIG. 4 depicts a plurality of heating elements 108 arranged along concave inner surface 444 of a portion of wall 442 that defines inner cavity 400 of a furnace according to an embodiment of the invention. Cover 236 of each heating element 108 has a length that is substantially the same as height H of wall 442, wherein each connector 238 and electrical leads 240 are disposed on top of wall 442 outside of heated cavity 400.

Figure 5:
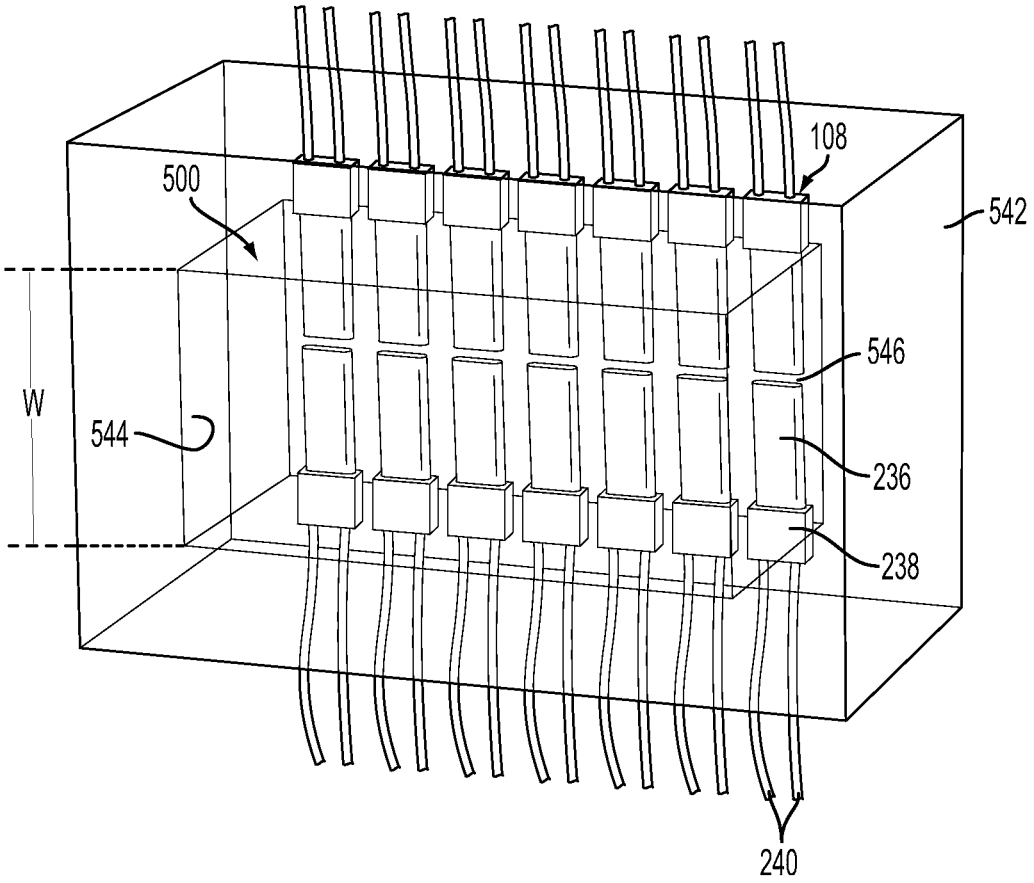
FIGS. 5 through 8 depict, for a fluxer having a rectangular inner cavity, various arrangements for a plurality of the heating element of FIG. 2.

FIG. 5 depicts a plurality of heating elements 108 arranged in two rows (7×1 arrays) along back portion of inner surface 544 of wall 542 that defines rectangular inner cavity 500 of a furnace.

Cover 236 of each heating element 108 has a length that is approximately half the height H of cavity 500, with a small gap 546 separating each upper heating element 108 from the heating element directly below it. The connectors 238 and electrical leads 240 of the top and bottom heating elements 108 are disposed outside of inner cavity 500.

Figure 6:
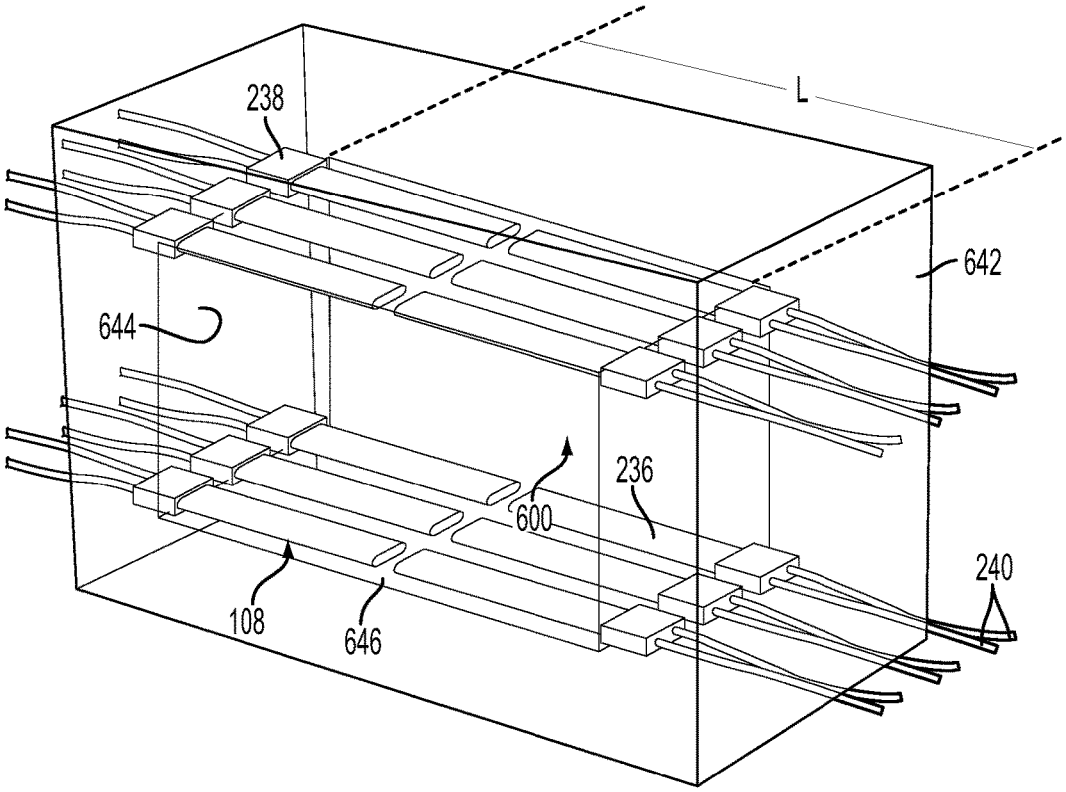

FIG. 6 depicts a plurality of heating elements 108 arranged in two, 3×2 arrays, one along each of the top and bottom portions of inner surface 644 of wall 642 that defines rectangular inner cavity 600 of a furnace. Cover 236 of each heating element 108 has a length that is approximately half the length L of the cavity, with small gap 646 separating each of heating elements 108.

Figure 7:
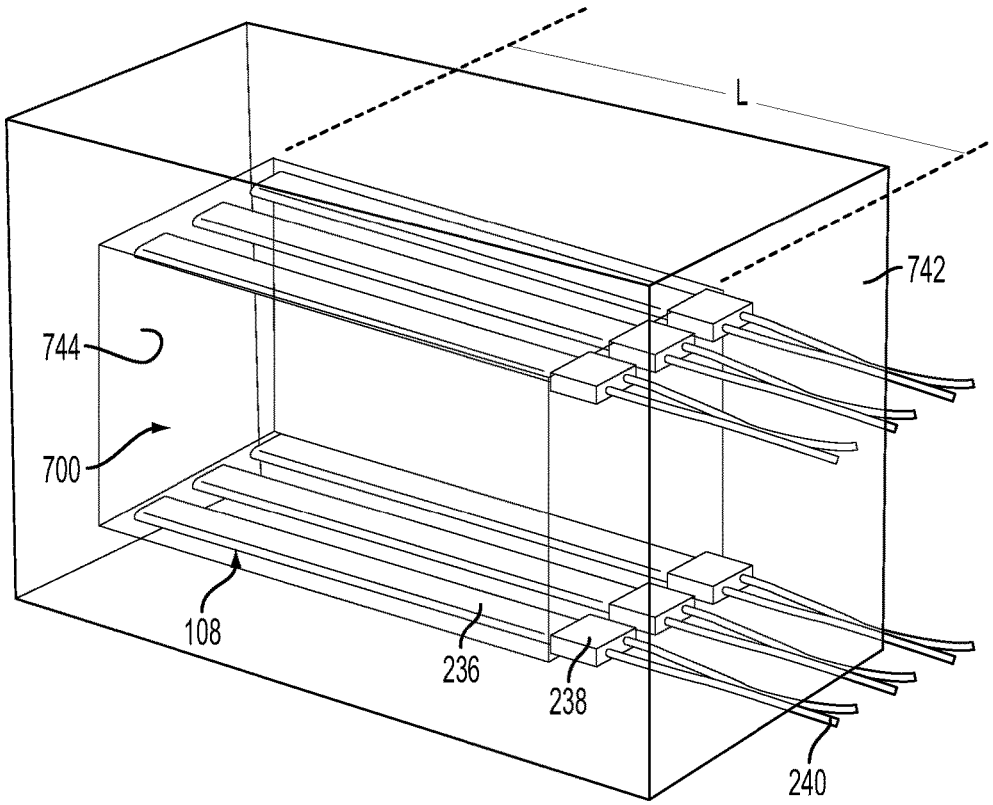

FIG. 7 depicts a plurality of heating elements 108 arranged in a 3×1 array along each of the top and bottom portions of inner surface 744 of wall 742 that defines rectangular inner cavity 700. Cover 236 of each heating element has a length that is substantially the same as the length L of the cavity. Connection point 238 and electrical leads 240 of each heating element 108 are all arranged on one side of, and outside of, cavity 700.

Figure 8:
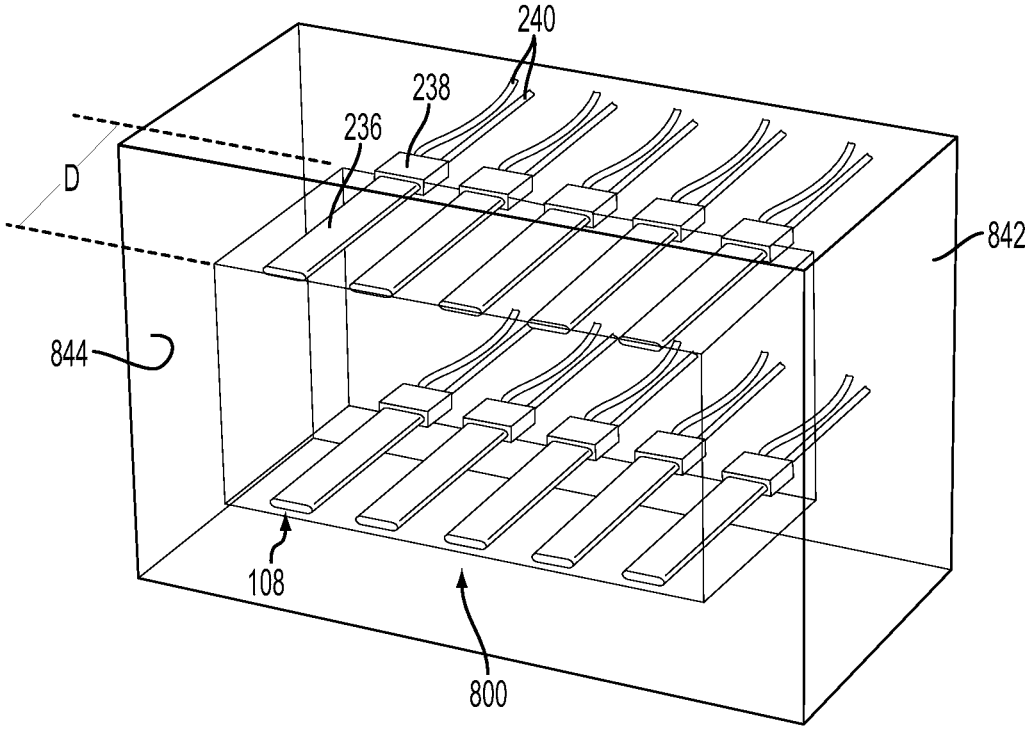

FIG. 8 depicts a plurality of heating elements 108 arranged in two 5×1 arrays on the upper and lower portions of inner surface 844 of wall 842 that defines inner cavity 800. Heating elements 108 in each array are arranged from the back to the front of cavity 800, spanning the depth D thereof. Cover 236 of each heating element 108 has a length that is substantially the same as depth D of cavity 800. Connector 238 and electrical leads 240 of each heating element 108 are all outside of cavity 800 and toward the back end thereof.

Figure 9:
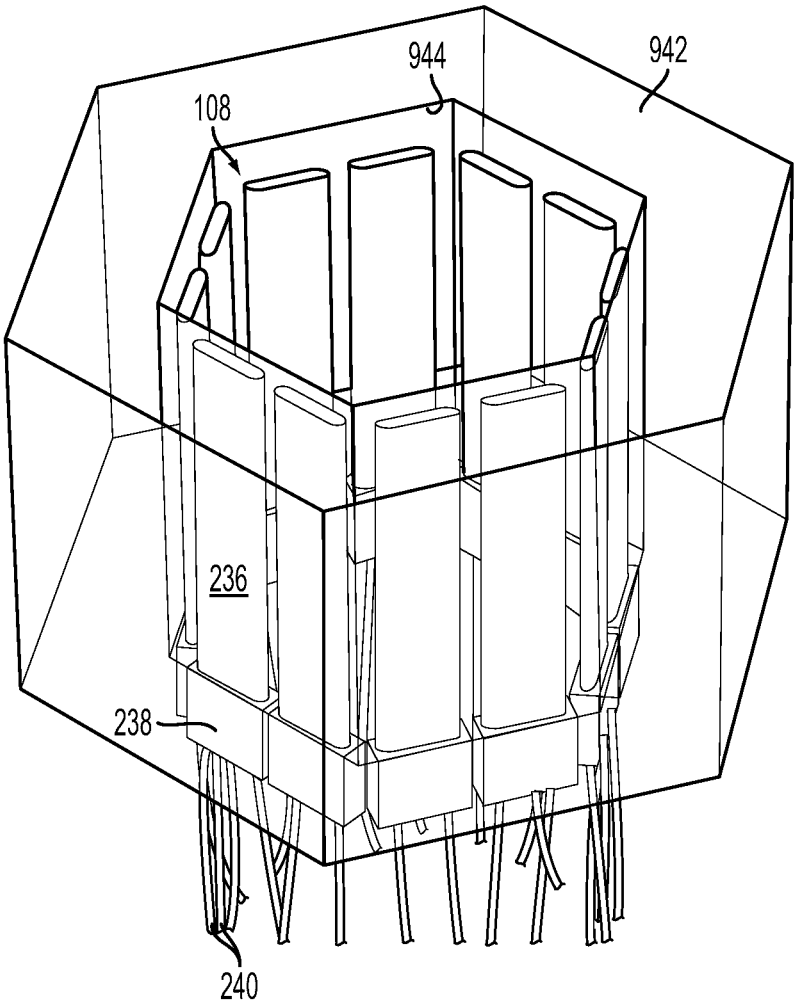
FIG. 9 depicts a plurality of the heating element of FIG. 2 arranged along the inner surface of a wall that defines a polygonal inner cavity of a fluxer.

FIG. 9 depicts a plurality of heating elements 108 arranged along inner surface 944 of wall 942 that defines polygonal inner cavity 900 of a furnace according to an embodiment of the invention. Cover 236 of each heating element 108 has a length that is substantially the same as height H of wall 442, wherein each connector 238 and electrical leads 240 are disposed below wall 442 outside of heated cavity 900.

In the embodiment depicted in FIG. 9, inner cavity 900 is hexagonal; it has six straight segments that define inner surface 944, wherein two heating elements 108 are disposed on each such segment. Cover 236 of each heating element 108 has a length that is substantially the same as height H of wall 942. Each connector 238 and electrical leads 240 are disposed outside of and below cavity 900. Although inner cavity 900 is six-sided, other polygonal shapes, such as five-sided, etc., may suitably be used.

Figure 10:
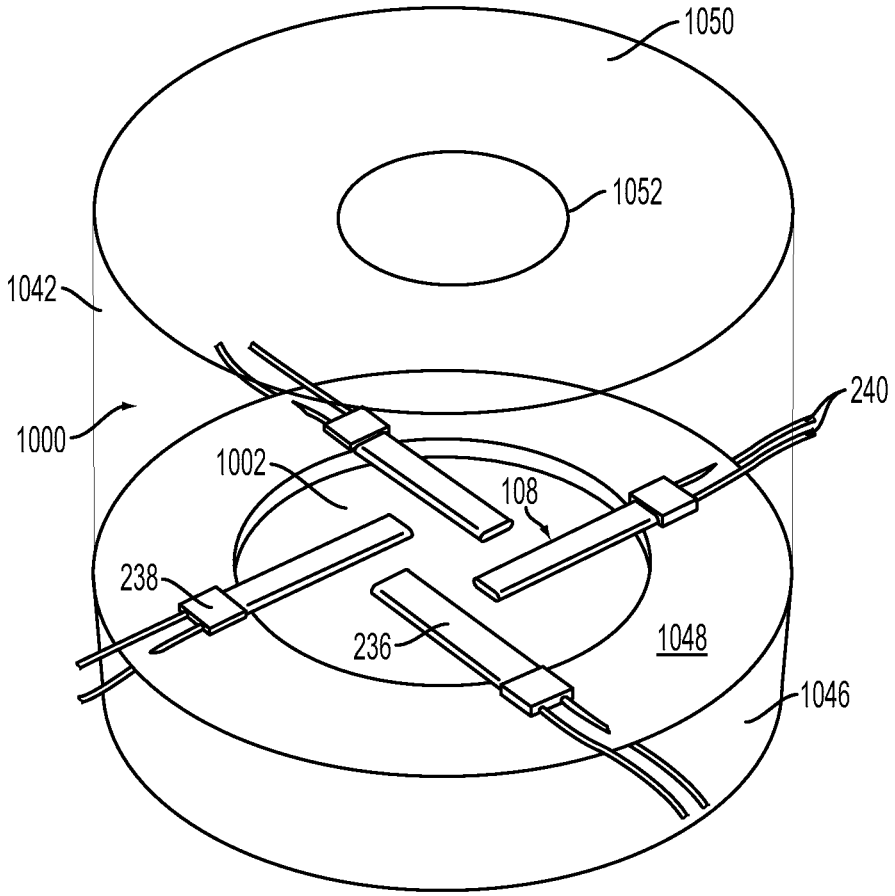
FIG. 10 depicts a plurality of the heating element of FIG. 2 arranged for use in a cylindrical inner cavity of a single-crucible fluxer.

FIG. 10 depicts a plurality of the heating element of FIG. 2 arranged on base 1046 of wall 1042 that defines cylindrical inner cavity 1000 of a fluxer according to an embodiment of the invention. As depicted in the figure, connector 238 of each heating element 108 is arranged along a lip or marginal region 1048 of base 1046. The cover 236 of each heating element 108 extends inward, over recess 1002, towards the center of inner cavity 1000. In the embodiment depicted in FIG. 10, the covers are positioned such that the tip of one cover is perpendicular to the sidewall of another cover. However, it will be clear to those skilled in the art that the covers can extend inwardly over recess 1002 at different angles depending, for example, on the number of heating elements that are arranged on base 1046. According to the illustrative embodiment, recess 1002 enables inner cavity 1000 to contain heat better and to catch potential molten flux spills.

Cap 1050 having opening 1052 is disposed on top of wall 1042. Opening 1052 receives a plate-shaped mold (not depicted) so that the mold can be heated by heating elements 108 while a sample is being dissolved in a crucible (not depicted) by another group of heating elements 108 (not depicted), located above cap 1050. The plate-shaped mold can be approximately 30-40 mm in diameter with a 3-7 mm height, for example. Once the sample has been dissolved, the molten flux is poured into the heated mold.

Figure 11:
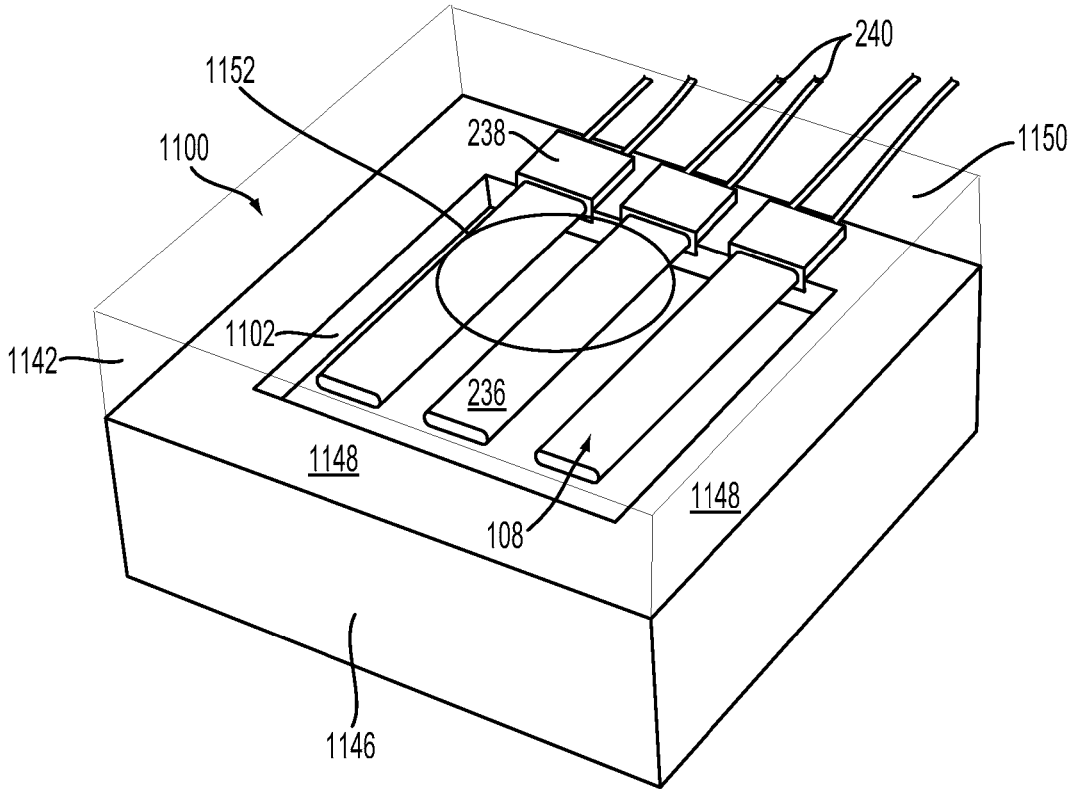
FIG. 11 depicts a plurality of the heating element of FIG. 2 arranged for use in a rectangular inner cavity of a single-crucible fluxer.

FIG. 11 depicts a plurality of the heating element 108 of FIG. 2 arranged on base 1146 of wall 1142 that defines inner cavity 1100. Connector 238 of each heating element 108 is arranged on one portion of a lip or marginal region 1148 of base 1146. The cover 236 of each heating element 108 extends over recess 1102 toward the lip on the opposite side of base 1146. Like the embodiment depicted in FIG. 10, recess 1102 enables inner cavity 1100 to contain heat better and to catch potential molten flux spills.

Cap 1150 having opening 1152 is disposed on top of wall 1142. Opening 1152 receives a plate-shaped mold (not depicted) so that the mold can be heated.

It will be appreciated that the number of heating elements 108 and the particular arrangement thereof into arrays of certain sizes, as depicted in the various embodiments shown herein, is for purposes of illustration not limitation. In other embodiments, as appropriate for the size of the inner cavity and the size of the heating elements, different-sized arrays of with different dimensions may suitably be used.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. A fluxer comprising:

a heating element, wherein the heating element includes:

(i) a filament having a first portion characterized by a first electrical resistance and a second portion characterized by a second electrical resistance, wherein the first electrical resistance is lower than the second electrical resistance, the first portion creating a first heating zone having a relatively lower temperature than a second heating zone created by the second portion when an electrical current is applied;

(ii) a connector comprising ceramic, wherein the connector connects one or more electrical leads to the first portion of the filament, wherein the first portion of the filament is closer to the connector than the second portion of the filament; and (iii) a cover that encapsulates the filament but not the connector nor the electrical leads, wherein the cover comprises silicon nitride.

2. The fluxer of claim 1, wherein the filament comprises at least one material selected from the group consisting of silicon, tungsten, molybdenum, tantalum, niobium, rhenium, osmium, and carbon.

3. The fluxer of claim 1, wherein the filament comprises an electrically conductive material or semi-conductive material having a melting point of at least 1200° C.

4. The fluxer of claim 1, wherein the cover has a rectangular form.

5. The fluxer of claim 1, wherein the cover has a cylindrical form.

6. The fluxer of claim 1, wherein the cover has a square cross section.

7. The fluxer of claim 1, wherein the cover has a U-shaped form.

8. The fluxer of claim 1, further comprising a plurality of heating elements having the features of (i) through (iii).

9. The fluxer of claim 8, further comprising an inner cavity, wherein the inner cavity is defined by a wall, wherein the filament and encapsulating cover of each heating element in the plurality thereof are disposed along an inner surface of at least a portion of the wall.

10. The fluxer of claim 9, wherein a length of each cover of each heating element is substantially equal to a height of the inner cavity.

11. The fluxer of claim 9, wherein a length of each cover of each heating element is substantially equal to one-half of a height of the inner cavity.

12. The fluxer of claim 9 wherein the inner cavity is cylindrical.

13. The fluxer of claim 9, wherein the inner cavity is rectangular and is characterized by a height, and wherein the inner surface of the wall includes a back surface, a top surface, a bottom surface, and two side surfaces, wherein the plurality of the heating elements are disposed along the back surface.

14. The fluxer of claim 13, wherein a length of each cover of each heating element is substantially equal to one-half of the height of the inner cavity.

15. The fluxer of claim 13, wherein a length of each cover of each heating element is substantially equal to the height of the inner cavity.

16. The fluxer of claim 9, wherein the inner cavity is rectangular and is characterized by a length, and wherein the inner surface of the wall includes a back surface, a top surface, a bottom surface, and two side surfaces, wherein a first portion of the plurality of the heating elements are disposed along the top surface and a second portion of the plurality of the heating elements are disposed on the bottom surface.

17. The fluxer of claim 16, wherein a length of each cover of each heating element is substantially equal to the length of the cavity.

18. The fluxer of claim 16, wherein a length of each cover of each heating element is substantially equal to one-half of the length of the cavity.

19. The fluxer of claim 16, wherein a length of each cover of each heating element is substantially equal to a depth of the cavity.

20. The fluxer of claim 9, wherein the inner surface of the wall has plural segments, wherein an equal number of heating elements from the plurality thereof are disposed along each segment.

* * * * *